US008656537B2

(12) United States Patent
Leifermann et al.

(10) Patent No.: US 8,656,537 B2
(45) Date of Patent: Feb. 25, 2014

(54) MULTI-COMPONENT PILLOW AND METHOD OF MANUFACTURING AND ASSEMBLING SAME

(75) Inventors: Bente Leifermann, Odense (DK); Trine Thrane, Odense (DK); Kirsten Maarbjerg, Odense (DK); Torben Mikkelsen, Kolding (DK)

(73) Assignee: Dan Foam ApS, Aarup (DK)

( * ) Notice: Subject to any disclaimer, the term of this patent is extended or adjusted under 35 U.S.C. 154(b) by 1287 days.

(21) Appl. No.: 11/407,760

(22) Filed: Apr. 20, 2006

(65) Prior Publication Data

US 2007/0245493 A1 Oct. 25, 2007

(51) Int. Cl.
*A47C 20/00* (2006.01)

(52) U.S. Cl.
USPC ..... 5/636; 5/638; 5/643; 5/645; 5/655.9

(58) Field of Classification Search
USPC ..... 5/636, 638, 643, 645, 655.9, 740, 953
See application file for complete search history.

(56) References Cited

U.S. PATENT DOCUMENTS

| | | | |
|---|---|---|---|
| D28,903 | S | 6/1898 | Amory |
| 1,312,886 | A | 8/1919 | Bawden |
| 1,382,831 | A | 6/1921 | Hiker |
| D59,900 | S | 12/1921 | Marsh |
| 1,742,186 | A | 1/1930 | Claus |
| 1,876,591 | A | 9/1932 | Bawden |
| D94,702 | S | 2/1935 | Marks |
| 2,013,481 | A | 9/1935 | Stonehill |
| 2,056,767 | A | 10/1936 | Blath |
| 2,149,140 | A | 2/1939 | González-Rincones |
| 2,167,622 | A | 8/1939 | Bentivoglio |
| D126,825 | S | 4/1941 | Kolisch |
| 2,295,906 | A | 9/1942 | Lacour |
| 2,298,218 | A | 10/1942 | Madson |

(Continued)

FOREIGN PATENT DOCUMENTS

| | | |
|---|---|---|
| DE | 10005919 | 8/2001 |
| DE | 20207664 U | 8/2002 |

(Continued)

OTHER PUBLICATIONS

"Leg Cushion," OrthoSupport™ *Sleep Buddy*, http://www.orthosupport.com/sleep_buddy.htm, OrthoSupport International Co, 2000, 2 pages.

(Continued)

*Primary Examiner* — Robert G Santos
*Assistant Examiner* — David E Sosnowski

(57) ABSTRACT

Some embodiments of disclosed pillow comprise a first sleeve within which is retained a plurality of loose pieces of filler material, a second sleeve in which the first sleeve is received, and a unitary piece of foam retained between the first and second sleeves. In some embodiments, the unitary piece of foam comprises viscoelastic foam, and can be elongated to run along a side of the first sleeve, can be substantially flat to cover a face of the first sleeve, or can take other shapes and be located in other positions as desired. Also, in some embodiments the unitary piece of foam is shaped to mate with the first sleeve. Additional unitary pieces of foam can be located adjacent the first sleeve and can be retained between the first and second sleeves to provide pillows having other support and cushioning characteristics.

41 Claims, 2 Drawing Sheets

(56) References Cited

U.S. PATENT DOCUMENTS 2,522,120 A 9/1950 Kaskey
2,552,476 A 5/1951 Barton
2,700,779 A 2/1955 Tolkowsky
2,724,133 A 11/1955 Sorrell
2,759,200 A 8/1956 Johnston
2,765,480 A 10/1956 Mueller
2,835,905 A 5/1958 Tomasson
2,880,428 A 4/1959 Forsland
2,898,975 A 8/1959 Wagner
3,000,020 A 9/1961 Lomabrd et al.
3,047,517 A 7/1962 Wherley
3,047,888 A 11/1962 Shecter et al.
3,124,812 A 3/1964 Milton et al.
3,148,389 A 9/1964 Lustig
3,287,750 A * 11/1966 Jessup ..... 428/74
3,327,330 A 6/1967 McCullough
D211,244 S 6/1968 Hawley
3,400,413 A 9/1968 La Grossa
3,469,882 A 9/1969 Larsen
3,574,397 A 4/1971 Norriss
3,604,023 A 9/1971 Lynch
3,606,461 A 9/1971 Moriyama
3,637,458 A 1/1972 Parrish
3,757,365 A 9/1973 Kretchmer
D230,804 S 3/1974 Lijewski
3,795,018 A 3/1974 Broaded
3,829,917 A 8/1974 De Laittre et al.
3,833,259 A 9/1974 Pershing
3,837,021 A 9/1974 Sellers et al.
3,870,662 A 3/1975 Lundberg
3,896,062 A 7/1975 Morehouse
3,906,137 A 9/1975 Bauer
D238,235 S 12/1975 Elgebrandt
3,939,508 A 2/1976 Hall et al.
3,987,507 A 10/1976 Hall
4,007,503 A 2/1977 Watkin
4,027,888 A 6/1977 Wilcox
4,060,863 A 12/1977 Craig
4,065,150 A 12/1977 Van Auken
D247,312 S 2/1978 Zeiss
4,086,675 A 5/1978 Talbert et al.
4,118,813 A 10/1978 Armstrong
4,173,048 A 11/1979 Varaney
4,177,806 A 12/1979 Griffin
4,185,673 A 1/1980 Daniello
4,190,697 A 2/1980 Ahrens
4,218,792 A 8/1980 Kogan
D258,557 S 3/1981 Herr
D258,793 S 4/1981 Rinz
D259,381 S 6/1981 Smith
D260,125 S 8/1981 Rogers
4,374,172 A 2/1983 Schwarz et al.
4,379,856 A 4/1983 Samaritter et al.
4,454,309 A 6/1984 Gould et al.
4,480,346 A 11/1984 Hawkins et al.
4,496,535 A 1/1985 Gould et al.
D278,779 S 5/1985 Sink
D279,642 S 7/1985 Ross
D282,427 S 2/1986 O'Sullivan
4,571,761 A 2/1986 Perlin
4,580,301 A 4/1986 Ludman et al.
4,584,730 A 4/1986 Rajan
D284,724 S 7/1986 Clark et al.
4,606,088 A 8/1986 Michaelsen et al.
4,624,021 A 11/1986 Hofstetter
4,698,864 A 10/1987 Graebe
4,736,477 A 4/1988 Moore
4,748,768 A 6/1988 Jacobsen
4,754,510 A 7/1988 King
4,755,411 A 7/1988 Wing et al.
4,759,089 A 7/1988 Fox
4,773,107 A 9/1988 Josefek
4,773,142 A 9/1988 Davis et al.
D298,198 S 10/1988 O'Sullivan
4,777,855 A 10/1988 Cohen
4,788,728 A 12/1988 Lake
4,799,275 A 1/1989 Sprague, Jr.
4,808,469 A 2/1989 Hiles
4,810,685 A 3/1989 Twigg et al.
4,821,355 A 4/1989 Burkhardt
4,826,882 A 5/1989 Bredbenner et al.
4,832,007 A 5/1989 Davis, Jr. et al.
4,840,430 A 6/1989 Shimada
4,842,330 A 6/1989 Jay
4,843,662 A 7/1989 Handelman
D302,592 S 8/1989 Holmes
4,862,539 A 9/1989 Bokich
4,863,712 A 9/1989 Twigg et al.
4,864,669 A 9/1989 Jones
D303,897 S 10/1989 Phillips
D305,084 S 12/1989 Gyebnar
D306,245 S 2/1990 Akhtarekhavari
4,899,405 A 2/1990 Rothbard
4,908,893 A 3/1990 Smit
4,910,818 A 3/1990 Grabill et al.
4,916,765 A 4/1990 Castronovo, Jr.
D308,311 S 6/1990 Forsland
D308,787 S 6/1990 Youngblood
D309,689 S 8/1990 Bool
4,950,694 A 8/1990 Hager
4,959,880 A 10/1990 Tesch
D314,116 S 1/1991 Reed
4,987,156 A 1/1991 Tozune et al.
5,006,569 A 4/1991 Stone
5,010,610 A 4/1991 Ackley
5,018,231 A 5/1991 Wang
5,018,790 A 5/1991 Jay
5,019,602 A 5/1991 Lowe
5,031,261 A 7/1991 Fenner, Sr.
D319,751 S 9/1991 Hoff
5,049,591 A 9/1991 Hayashi et al.
D320,715 S 10/1991 Magnin et al.
5,054,143 A 10/1991 Javaher
5,061,737 A 10/1991 Hudson
D321,562 S 11/1991 Ljungvall
5,088,141 A 2/1992 Meyer et al.
D325,839 S 5/1992 Main
5,114,989 A 5/1992 Elwell et al.
5,117,522 A 6/1992 Everett
5,121,515 A 6/1992 Hudson
5,123,133 A 6/1992 Albert
5,125,123 A 6/1992 Engle
5,138,732 A 8/1992 Wattie et al.
5,148,564 A 9/1992 Reder
D333,938 S 3/1993 Watson et al.
D334,318 S 3/1993 Chee
5,189,747 A 3/1993 Mundy et al.
D336,809 S 6/1993 Emery
5,216,771 A 6/1993 Hoff
5,219,893 A 6/1993 Konig et al.
5,228,158 A 7/1993 Park
5,230,947 A 7/1993 Ou
D341,509 S 11/1993 Evans
5,265,295 A 11/1993 Sturgis
D342,411 S 12/1993 Graebe
5,294,181 A 3/1994 Rose et al.
5,317,773 A 6/1994 Graebe
5,367,731 A 11/1994 O'Sullivan
D354,356 S 1/1995 Shiflett
D354,876 S 1/1995 Pace
5,382,602 A 1/1995 Duffy et al.
5,418,991 A 5/1995 Shiflett
D358,957 S 6/1995 Propp
D359,870 S 7/1995 McLaughlin
5,437,070 A 8/1995 Rempp
5,457,832 A 10/1995 Tatum
5,482,980 A 1/1996 Pcolinsky
D367,199 S 2/1996 Graebe
D367,390 S 2/1996 Johnston et al.
D369,663 S 5/1996 Gostine
5,522,106 A 6/1996 Harrison et al.
5,523,144 A 6/1996 Dyer, Jr.
5,528,784 A 6/1996 Painter
5,530,980 A 7/1996 Sommerhalter, Jr.

(56) References Cited

U.S. PATENT DOCUMENTS 5,537,703 A 7/1996 Launder et al.
5,544,377 A 8/1996 Gostine
D374,146 S 10/1996 Bonaddio et al.
5,567,740 A 10/1996 Free
5,572,757 A 11/1996 O'Sullivan
D377,575 S 1/1997 Lowrey, Jr. et al.
5,591,780 A 1/1997 Muha et al.
5,638,564 A 6/1997 Greenawalt et al.
5,644,809 A 7/1997 Olson
D381,855 S 8/1997 Galick
D382,163 S 8/1997 Hartney
D383,026 S 9/1997 Torbik
5,664,271 A 9/1997 Ballavance
5,669,094 A 9/1997 Swanson
5,682,633 A 11/1997 Davis
5,687,436 A 11/1997 Denton
D387,235 S 12/1997 Carpenter
D388,648 S 1/1998 Bates
D388,649 S 1/1998 Chekuri
D388,650 S 1/1998 Davis
5,708,998 A 1/1998 Torbik
D390,405 S 2/1998 Jung
D391,112 S 2/1998 Houston
5,724,685 A 3/1998 Weismiller et al.
D393,564 S 4/1998 Liu
5,746,218 A 5/1998 Edge
D394,977 S 6/1998 Frydman
D395,568 S 6/1998 Davis
5,778,470 A 7/1998 Haider
5,781,947 A 7/1998 Sramek
D397,270 S 8/1998 Maalouf
5,797,154 A 8/1998 Contreras
5,809,594 A * 9/1998 Isogai ..... 5/645
D399,675 S 10/1998 Ferris
D402,150 S 12/1998 Wurmbrand et al.
5,848,448 A 12/1998 Boyd
D404,237 S 1/1999 Boyd
5,855,415 A 1/1999 Lilley, Jr.
5,884,351 A 3/1999 Tonino
D409,038 S 5/1999 Rojas, Jr. et al.
D410,810 S 6/1999 Lozier
D412,259 S 7/1999 Wilcox et al.
5,926,880 A 7/1999 Sramek
D415,920 S 11/1999 Denney
D416,742 S 11/1999 Sramek
D417,579 S 12/1999 Tarquinio
D417,997 S 12/1999 Yannakis
6,003,177 A 12/1999 Ferris
D418,711 S 1/2000 Mettler
6,017,601 A 1/2000 Amsel
6,018,831 A 2/2000 Loomos
6,034,149 A 3/2000 Bleys et al.
6,047,419 A 4/2000 Ferguson
6,049,927 A 4/2000 Thomas et al.
6,052,851 A 4/2000 Kohnle
6,079,066 A 6/2000 Backlund
6,093,468 A 7/2000 Toms et al.
D428,716 S 8/2000 Larger
D429,106 S 8/2000 Bortolotto et al.
6,115,861 A 9/2000 Reeder et al.
6,136,879 A 10/2000 Nishida et al.
D434,936 S 12/2000 May
6,154,905 A 12/2000 Frydman
6,156,842 A 12/2000 Hoenig et al.
6,159,574 A 12/2000 Landvik et al.
6,161,238 A 12/2000 Graebe
6,171,532 B1 1/2001 Sterzel
6,182,311 B1 2/2001 Buchanan et al.
6,182,312 B1 2/2001 Walpin
6,182,314 B1 2/2001 Frydman
D439,099 S 3/2001 Erickson
6,202,232 B1 3/2001 Andrei
6,202,239 B1 3/2001 Ward et al.
6,204,300 B1 3/2001 Kageoka et al.
6,226,818 B1 5/2001 Rudick
6,237,173 B1 5/2001 Schlichter et al.
6,241,320 B1 6/2001 Chew et al.
6,245,824 B1 6/2001 Frey et al.
D445,505 S 7/2001 Shapiro
6,253,400 B1 7/2001 Rüdt-Sturzenegger et al.
6,254,189 B1 7/2001 Closson
D446,305 S 8/2001 Buchanan et al.
6,292,964 B1 9/2001 Rose et al.
6,317,908 B1 11/2001 Walpin
6,321,402 B1 11/2001 Ming-Chung
6,327,725 B1 12/2001 Veilleux et al.
6,345,401 B1 2/2002 Frydman
6,347,421 B1 2/2002 D'Emilio
D455,311 S 4/2002 Fux
6,367,106 B1 4/2002 Gronsman
6,391,933 B1 5/2002 Mattesky
6,391,935 B1 5/2002 Hager et al.
6,401,283 B2 6/2002 Thomas et al.
6,408,467 B2 6/2002 Walpin
6,412,127 B1 7/2002 Cuddy
D463,701 S 10/2002 Borcherding et al.
6,471,726 B2 10/2002 Wang
D465,686 S 11/2002 Hwong
D466,750 S 12/2002 Landvik
D466,751 S 12/2002 Coats et al.
6,490,743 B1 12/2002 Adat et al.
6,491,846 B1 12/2002 Reese, II et al.
6,513,179 B1 2/2003 Pan
D471,750 S 3/2003 Jamvold et al.
6,541,094 B1 4/2003 Landvik et al.
D474,364 S 5/2003 Arcieri
D474,637 S 5/2003 Scheetz
6,574,809 B1 6/2003 Rathbun
6,578,220 B1 6/2003 Smith
6,583,194 B2 6/2003 Sendijarevic
6,594,838 B1 7/2003 Hollander et al.
6,602,579 B2 8/2003 Landvik
6,617,014 B1 9/2003 Thomson
6,617,369 B2 9/2003 Parfondry et al.
6,625,829 B2 9/2003 Zell
6,634,045 B1 10/2003 DuDonis et al.
6,635,688 B2 10/2003 Simpson
6,653,362 B2 11/2003 Toyota et al.
6,653,363 B1 11/2003 Tursi, Jr. et al.
6,663,537 B2 12/2003 McCoy
6,671,907 B1 1/2004 Zuberi
6,687,933 B2 2/2004 Habboub et al.
6,699,917 B2 3/2004 Takashima
6,701,558 B2 3/2004 VanSteenburg
D489,749 S 5/2004 Landvik
6,733,074 B2 5/2004 Groth
6,734,220 B2 5/2004 Niederoest et al.
6,742,207 B1 6/2004 Brown
6,751,818 B2 6/2004 Troop
6,756,415 B2 6/2004 Kimura et al.
6,779,211 B1 8/2004 Williams
D496,205 S 9/2004 Baddour
6,810,541 B1 11/2004 Woods
6,813,790 B2 11/2004 Flick et al.
6,845,534 B1 1/2005 Huang
6,848,128 B2 2/2005 Verbovszky et al.
6,857,151 B2 2/2005 Jusiak et al.
6,866,915 B2 3/2005 Landvik
6,872,758 B2 3/2005 Simpson et al.
D504,269 S 4/2005 Faircloth
6,877,176 B2 4/2005 Houghteling
6,915,539 B2 7/2005 Rathbun
6,928,677 B1 8/2005 Pittman
6,966,090 B2 11/2005 McClintock et al.
7,051,389 B2 5/2006 Wassilefky
7,059,001 B2 6/2006 Woolfson
D529,325 S 10/2006 Maarbjerg
7,255,917 B2 8/2007 Rochlin et al.
D558,499 S 1/2008 Maarbjerg
7,415,742 B2 8/2008 Wassilefsky
2001/0000829 A1 5/2001 Thomas et al.
2001/0003219 A1* 6/2001 Chou ..... 5/636
2001/0018777 A1 9/2001 Walpin
2001/0027577 A1 10/2001 Frydman

(56) References Cited

U.S. PATENT DOCUMENTS

| | | | |
|---|---|---|---|
| 2001/0032365 | A1 | 10/2001 | Sramek |
| 2001/0054200 | A1 | 12/2001 | Romano et al. |
| 2002/0018884 | A1 | 2/2002 | Thomson |
| 2002/0019654 | A1 | 2/2002 | Ellis et al. |
| 2002/0028325 | A1 | 3/2002 | Simpson |
| 2002/0043736 | A1 | 4/2002 | Murakami et al. |
| 2002/0088057 | A1 | 7/2002 | Wassilefsky |
| 2002/0099106 | A1 | 7/2002 | Sendijarevic |
| 2002/0112287 | A1 | 8/2002 | Thomas et al. |
| 2002/0122929 | A1 | 9/2002 | Simpson et al. |
| 2002/0124318 | A1 | 9/2002 | Loomos |
| 2002/0128420 | A1 | 9/2002 | Simpson et al. |
| 2003/0005521 | A1 | 1/2003 | Sramek |
| 2003/0014820 | A1 | 1/2003 | Fuhriman |
| 2003/0037376 | A1 | 2/2003 | Zell |
| 2003/0045595 | A1 | 3/2003 | Toyota et al. |
| 2003/0065046 | A1 | 4/2003 | Hamilton |
| 2003/0087979 | A1 | 5/2003 | Bleys et al. |
| 2003/0105177 | A1 | 6/2003 | Parfondry et al. |
| 2003/0124337 | A1 | 7/2003 | Price et al. |
| 2003/0131419 | A1 | 7/2003 | VanSteenburg |
| 2003/0145384 | A1 | 8/2003 | Stelnicki |
| 2003/0150061 | A1 | 8/2003 | Farley |
| 2003/0182727 | A1 | 10/2003 | DuDonis et al. |
| 2003/0186044 | A1 | 10/2003 | Sauniere et al. |
| 2003/0188383 | A1 | 10/2003 | Ense |
| 2003/0188385 | A1 | 10/2003 | Rathbun |
| 2003/0192119 | A1 | 10/2003 | Verbovszky et al. |
| 2003/0200609 | A1 | 10/2003 | Jusiak et al. |
| 2003/0218003 | A1 | 11/2003 | Ellis et al. |
| 2003/0229154 | A1 | 12/2003 | Kemmler et al. |
| 2004/0000804 | A1 | 1/2004 | Groth |
| 2004/0019972 | A1 | 2/2004 | Schecter et al. |
| 2004/0044091 | A1 | 3/2004 | Niederoest et al. |
| 2004/0087675 | A1 | 5/2004 | Yu |
| 2004/0097608 | A1 | 5/2004 | Re'em |
| 2004/0112891 | A1 | 6/2004 | Ellis et al. |
| 2004/0139548 | A1 | 7/2004 | Hwang-Pao |
| 2004/0139550 | A1 | 7/2004 | Calagui |
| 2004/0142619 | A1 | 7/2004 | Ueno et al. |
| 2004/0155498 | A1 | 8/2004 | Verbovszky et al. |
| 2004/0155515 | A1 | 8/2004 | Verbovszky et al. |
| 2004/0164499 | A1 | 8/2004 | Murakami et al. |
| 2004/0181003 | A1 | 9/2004 | Murakami et al. |
| 2004/0226098 | A1 | 11/2004 | Pearce |
| 2004/0229970 | A1 | 11/2004 | Sasaki et al. |
| 2004/0266897 | A1 | 12/2004 | Apichatachutapan et al. |
| 2004/0266900 | A1 | 12/2004 | Neff et al. |
| 2005/0000022 | A1 | 1/2005 | Houghteling |
| 2005/0005358 | A1 | 1/2005 | DuDonis |
| 2005/0005362 | A1 | 1/2005 | Verbovszky |
| 2005/0022307 | A1 | 2/2005 | McClintock et al. |
| 2005/0038133 | A1 | 2/2005 | Neff et al. |
| 2005/0043423 | A1 | 2/2005 | Schmidt et al. |
| 2005/0060807 | A1 | 3/2005 | Kaizuka |
| 2005/0060809 | A1 | 3/2005 | Rogers |
| 2005/0066445 | A1 | 3/2005 | Christofferson et al. |
| 2005/0076442 | A1* | 4/2005 | Wassilefky ..... 5/636 |
| 2005/0140199 | A1 | 6/2005 | Kang et al. |
| 2006/0277684 | A1 | 12/2006 | Wassilefky |
| 2007/0044239 | A1 | 3/2007 | Leifermann et al. |
| 2007/0113347 | A1 | 5/2007 | Lindell |
| 2007/0245493 | A1 | 10/2007 | Leifermann et al. |

FOREIGN PATENT DOCUMENTS

| | | | |
|---|---|---|---|
| DE | 10237089 | | 2/2004 |
| DE | 202004003248 | | 5/2004 |
| EP | 0323742 | | 7/1989 |
| EP | 0361418 | B | 4/1990 |
| EP | 0365954 | B | 5/1990 |
| EP | 0433878 | B | 6/1991 |
| EP | 0486016 | | 5/1992 |
| EP | 0608626 | B | 8/1994 |
| EP | 0713900 | B | 5/1996 |
| EP | 0718144 | B | 6/1996 |
| EP | 0908478 | B | 4/1999 |
| EP | 0934962 | B | 8/1999 |
| EP | 0940621 | | 9/1999 |
| EP | 1021115 | | 7/2000 |
| EP | 1060859 | B | 12/2000 |
| EP | 1125719 | B | 8/2001 |
| EP | 1167019 | | 1/2002 |
| EP | 1184149 | B | 3/2002 |
| EP | 1188785 | | 3/2002 |
| EP | 1405867 | | 4/2004 |
| EP | 1507469 | | 2/2005 |
| FR | 2396648 | B | 2/1979 |
| FR | 2598910 | | 11/1987 |
| FR | 2795371 | B | 12/2000 |
| FR | 2818187 | B | 6/2002 |
| GB | 1273259 | | 5/1972 |
| GB | 2290256 | B | 12/1995 |
| GB | 2297057 | | 7/1996 |
| GB | 2314506 | | 1/1998 |
| GB | 2383958 | | 7/2003 |
| GB | 2414178 | | 11/2005 |
| IT | 1238272 | | 7/1993 |
| IT | 00224783 | | 6/1996 |
| JP | 52-106961 | | 9/1977 |
| JP | 62-183790 | | 8/1987 |
| JP | 3128006 | | 5/1991 |
| JP | H9-37909 | | 7/1995 |
| JP | 2002-306283 | | 10/2002 |
| KR | 10-2002-60116 | | 7/2002 |
| RU | 2145181 | | 10/2000 |
| SE | 457327 | C | 12/1988 |
| WO | WO 8504150 | | 9/1985 |
| WO | WO 8607528 | | 12/1986 |
| WO | WO 9208759 | | 5/1992 |
| WO | WO 9321806 | | 11/1993 |
| WO | WO 9401023 | | 1/1994 |
| WO | WO 9416935 | | 8/1994 |
| WO | WO 9518184 | | 7/1995 |
| WO | WO 9519755 | | 7/1995 |
| WO | WO 9520622 | | 8/1995 |
| WO | WO 9528861 | | 11/1995 |
| WO | WO 9529658 | | 11/1995 |
| WO | WO 9803333 | | 1/1998 |
| WO | WO 9804170 | | 2/1998 |
| WO | WO 9841126 | | 9/1998 |
| WO | WO 9845359 | | 10/1998 |
| WO | WO 9850251 | | 11/1998 |
| WO | WO 9902077 | | 1/1999 |
| WO | WO 9908571 | | 2/1999 |
| WO | WO 9915126 | | 4/1999 |
| WO | WO 9944856 | | 9/1999 |
| WO | WO 9952405 | | 10/1999 |
| WO | WO 0017836 | | 3/2000 |
| WO | WO 0062850 | | 10/2000 |
| WO | WO 0105279 | | 1/2001 |
| WO | WO 0125305 | | 4/2001 |
| WO | WO 0128388 | | 4/2001 |
| WO | WO 0132736 | | 5/2001 |
| WO | WO 03066766 | | 8/2003 |
| WO | WO 03070061 | | 8/2003 |
| WO | WO 03072391 | | 9/2003 |
| WO | WO 03099079 | | 12/2003 |
| WO | WO 2004020496 | | 3/2004 |
| WO | WO 2004034847 | | 4/2004 |
| WO | WO 2004036794 | | 4/2004 |
| WO | WO 2004039858 | | 5/2004 |
| WO | WO 2004055624 | | 7/2004 |
| WO | WO 2004063088 | | 7/2004 |
| WO | WO 2004082436 | | 9/2004 |
| WO | WO 2004089682 | | 10/2004 |
| WO | WO 2004100829 | | 11/2004 |
| WO | WO 2004108383 | | 12/2004 |
| WO | WO 2005003205 | | 1/2005 |
| WO | WO 2005003206 | | 1/2005 |
| WO | WO 2005031111 | | 4/2005 |
| WO | WO 2005042611 | | 5/2005 |

(56) References Cited

FOREIGN PATENT DOCUMENTS

| | | |
|---|---|---|
| WO | WO 2005046988 | 5/2005 |
| WO | WO 2005065245 | 7/2005 |
| WO | WO 2005089297 | 9/2005 |

OTHER PUBLICATIONS

"Sleep Buddy™ Plus," OrthoSupport™ *Sleep Buddy Plus*, http://www.orthosupport.com/OL1032.htm, OrthoSupport International Co, 2000, 3 pages.

*Supple-Pedic* pillow, Strobel Technolgies, "Pillow Park Plaza," http://www.pillowpark.com/mat.asp, p. 2 (printed Jun. 27, 2000).

*Isotonic* pillow, Carpenter Co., http://www.carpenter.com/consumer/isotonic.htm, p. 1 (printed Jun. 27, 2000).

*BackSaver* All Position Pillow, BackSaver, Backsaver.com 2000, .../pg_product_detail.cfm?TID=23240507137636002706837 9&CFID=96050713 &CFTOK, p. 1 (printed Jun. 27, 2000).

Bay Jacobsen *ViscoFlex, CombiFlex*, Standard, Back Support, and Anatomical Sitting Wedge pillows, http://www.bayjacobsen.dk/content.asp?id=33, pp. 3 and 4 (printed Jun. 27, 2000).

"Advanced Comfort abed.com Pillows and Accessories," Advanced Comfort Mattresses, http://www.abed.com/cpillow.htm, p. 1 (printed Jun. 27, 2000).

"Supple-Pedic Pillows and Cushions," Strobel Technologies, http://www.strobelcom/supplepillow.htm, pp. 1 and 2 (printed Jun. 27, 2000).

"Splintek *SleepRight* Side Sleeping Pillow," http://www.splintek.com/ph/chirocontour.html, 2005 Splintek PP-Inc., pp. 1-3 (printed Nov. 14, 2005).

Sinomax.com.hk Home page, including picture of SINOMAX® My Beauty Pillow, http://www.sinomax.com.hk/en/home.html, 2003 Sinomax (Holding) Group Ltd., p. 1 (printed Dec. 13, 2004).

Sinomax.com.hk "About Us" link, narrative for SINOMAX® SINOMAX (Holding) Group "TV-228 My Beauty Pillow," http://www.sinomax.com.hk/en/oem/product/bedroom/pillow/detail.html?id=2337, 2003 Sinomax (Holding) Group Ltd., p. 1 (printed Dec. 13, 2004).

Sinomax.com.hk "Export" page, narrative for SINOMAX® SINOMAX (Holding) Group "Export—New & Hot Products," including, among other things, pillows and cushions, http://www.sinomax.com.hk.en.oem.overview.html, 2003 Sinomax (Holding) Group Ltd., pp. 1-3 (printed Dec. 13, 2004).

* cited by examiner

MULTI-COMPONENT PILLOW AND METHOD OF MANUFACTURING AND ASSEMBLING SAME

BACKGROUND OF THE INVENTION

Of the wide variety of different pillow types available on the market, the large majority are not well-adapted or adaptable for particular users. Typically, such pillows support a user's head (and frequently, a user's neck and shoulders) when the user lies in a supine, prone, or side-lying position. However, most conventional pillows are not designed to provide different types of support or user comfort in different areas of the pillow. Also, most conventional pillows are lacking in ergonomic design, resulting in a sacrifice of user comfort.

SUMMARY

Some embodiments of the present invention provide a pillow comprising an outer sleeve; an inner sleeve located within the outer sleeve and defining an internal cavity; a plurality of loose pieces of filler material contained within the internal cavity of the inner sleeve; and a first unitary piece of foam retained in a first position between the inner and outer sleeves.

In some embodiments, a method of assembling a pillow is provided, and comprises positioning a first sleeve containing a plurality of loose pieces of filler material adjacent a unitary piece of foam; inserting the first sleeve and the unitary piece of foam into a second sleeve; and retaining the unitary piece of foam and the first sleeve with the plurality of loose pieces of material in position with respect to one another.

Some embodiments of the present invention provide a pillow comprising a length; a width; a thickness substantially smaller than the length and width; a side extending along the length of the pillow; a sleeve defining an internal cavity; a plurality of loose pieces of filler material contained within the internal cavity of the sleeve; and an elongated and unitary piece of foam extending along the side and the sleeve of the pillow and adapted to provide user support at the side of the pillow.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
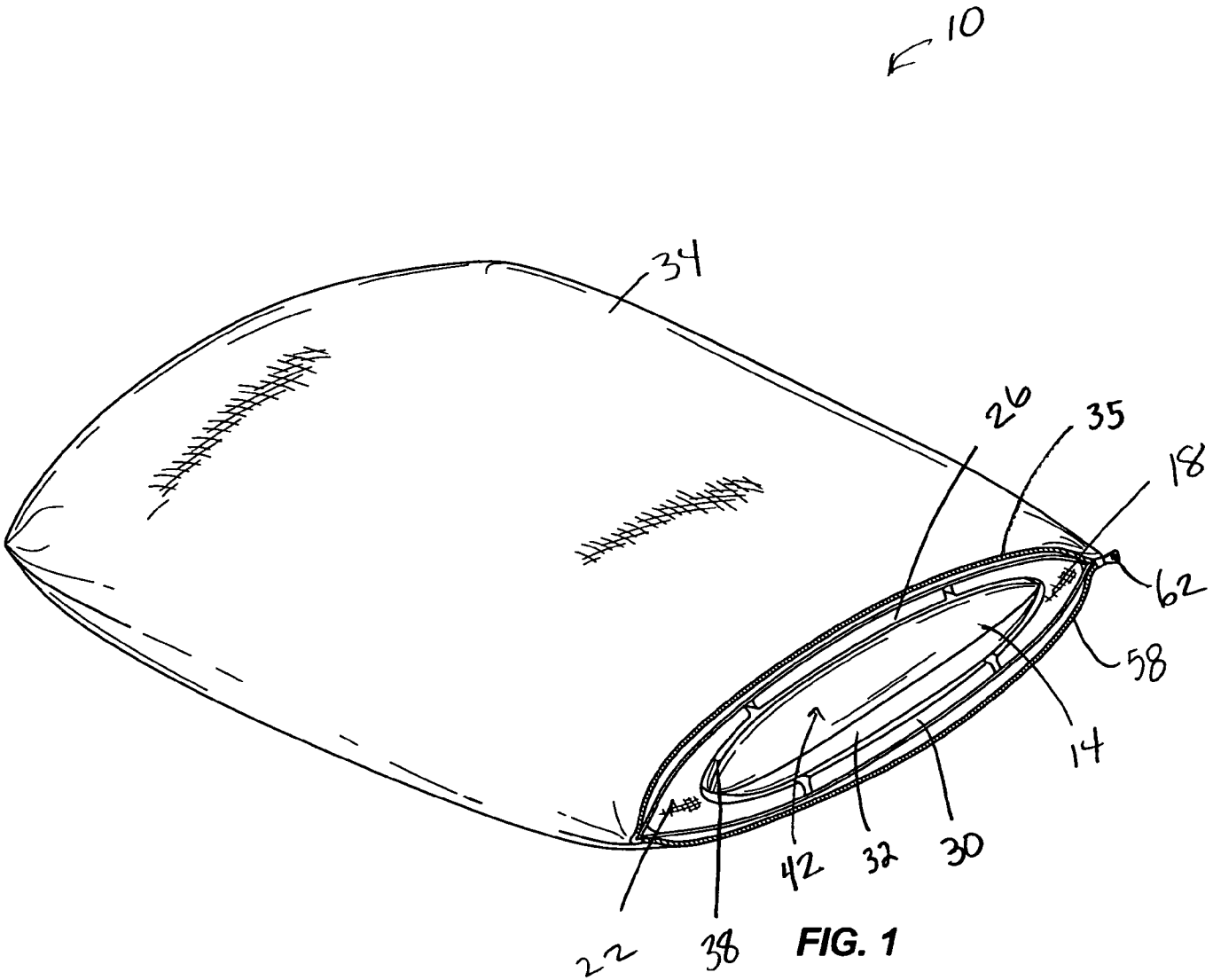
FIG. 1 is a perspective view of a pillow according to an embodiment of the present invention.
Figure 2:
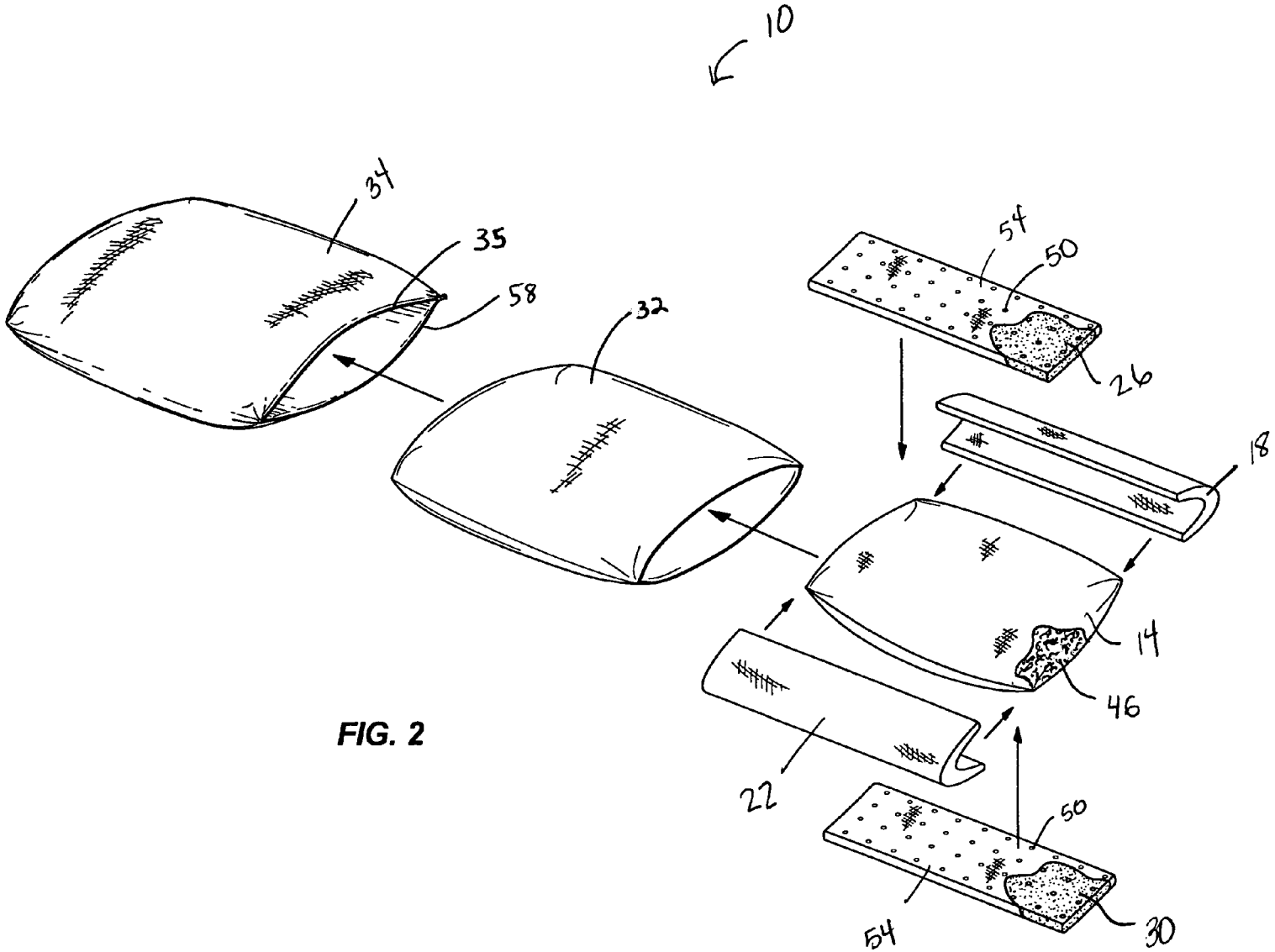
FIG. 2 is an exploded perspective view of the pillow shown in FIG. 1.

FIGS. 1 and 2 illustrate a pillow 10 according to an embodiment of the present invention, and having a construction composed of multiple components. The pillow 10 illustrated in FIGS. 1 and 2 has the general rectangular shape of a standard pillow. However, it will be appreciated that the pillow 10 can have any other shape desired, including without limitation those that are round, oval, rod, crescent, U-shaped, Y-shaped, L-shaped, star, irregular, and the like. The pillow 10 illustrated in FIGS. 1 and 2 comprises an inner sleeve 14 at least partially filled with filler material 46, first, second, third, and fourth foam pieces 18, 22, 26, 30, and an outer sleeve 32 to enclose the inner sleeve 14 and foam pieces 18, 22, 26, 30 of the pillow 10. In some embodiments, at least one of the foam pieces 18, 22, 26, 30 comprises viscoelastic foam.

The inner sleeve 14 defines a cavity 42 within which the filler material 46 is retained. The filler material 46 within the inner sleeve 14 is down, although other types of filler material can instead be employed. For example, the filler material 14 can include feathers, granulated cotton, cotton fibers, wool, beads, beans, latex, reticulated and/or non-reticulated viscoelastic and/or non-viscoelastic foam, other types of foam (in any of the granulated forms described herein), and the like. Also, the filler material 14 can be comprised of any single filler described herein or any combination of such fillers. In some embodiments, the filler material comprises a plurality of loose pieces of any of the material types described above. However, in other embodiments, the filler material need not necessarily comprise loose pieces.

The term "reticulated foam" is referenced herein to describe certain optional materials for the pillow 10. The cells of reticulated foam are essentially skeletal structures in which many (if not substantially all) of the cell walls separating one cell from another do not exist. In other words, the cells are defined by a plurality of supports or "windows", and by no cell walls, substantially no cell walls, or by a substantially reduced number of cell walls. A foam can be considered "reticulated" if at least 50% of the walls defining the cells of the foam do not exist (i.e., have been removed or were never allowed to form during the manufacturing process of the foam). The granulated viscoelastic foam of the filler material 14 can be 100% reticulated viscoelastic foam, 100% non-reticulated viscoelastic foam, or can include any relative amounts of reticulated and non-reticulated viscoelastic foams desired.

In those embodiments of the pillow 10 employing loose pieces of viscoelastic (reticulated or non-reticulated) material as filler material 46, the filler material 46 can be granulated, or shredded, viscoelastic foam having a density of about 85 $kg/m^3$. However, a suitable density for the viscoelastic foam filler material 46 for an average weight pillow 10, for example, can be between about 30 and about 140 kg/m'. Further, a suitable density for the viscoelastic foam filler material 46 for a light-weight pillow 10, for example, can be less than about 40 kg/m'. Likewise, a suitable density for the viscoelastic foam filler material 46 for a heavy-weight pillow 10, for example, can be greater than about 130 kg/m'. Alternatively, the granulated viscoelastic foam utilized as the filler material 46 can have any density in accordance with the desired characteristics of the pillow 10. In addition, a suitable viscoelastic foam filler material 46 possesses an indentation load deflection, or "ILD," of 65% between 100-500 N loading, and a maximum 10% rebound according to the test procedure governed by the ASTM-D-1564 standard.

If used, the viscoelastic granulated filler material 46 can be made up of recycled, virgin, or scrap viscoelastic material. As will be appreciated by one of ordinary skill in the art, the granulated filler material 46 can be produced in any manner desired, including without limitation by shredding, cutting, grinding, chopping, tearing, or ripping virgin, recycled, or scrap viscoelastic material, by molding or casting individual pieces, or in any other suitable manner. The granulated filler material 46 may consist of pieces of a nominal length, or the granulated filler material 46 may consist of pieces of varying length. For example, granulated filler material 46 may have a nominal length of about 1.3 cm. Also, granulated filler material 46 may consist of varying lengths between about 0.6 cm and about 2 cm. The granulated filler material 46 can be as short at 0.3 cm and as long as 4 cm., or the filler material 46 can be any length in accordance with the desired characteristics of the pillow 10. In some embodiments, the granulated filler material 46 is comprised of 16-20% having a length longer than 2 cm, 38-42% having a length between 1 and 2 cm, and 38-42% of the pieces shorter than 1 cm. Significant cost savings and waste reduction can be realized by using scrap or recycled filler material 46 rather than virgin filler material 46. Viscoelastic foam used as the filler material 46 can be made from a polyurethane foam material, however, the filler material 46 can be made from any other viscoelastic polymer material that exhibits similar thermally-responsive properties.

In those embodiments in which viscoelastic filler material 46 is utilized as described above, the composition of the filler material 46 can be varied to alter the characteristics of the pillow 10 and the cost of the pillow 10. In some embodiments of the present invention, the filler material 46 is a combination of granulated viscoelastic foam and a fiber material. The fiber material can be made from any kind of textile, such as an organic textile (cotton) or a synthetic textile. In some embodiments of the present invention, the fiber material has a density of about 1 g/cm$^3$. However, a suitable density for the fiber material for an average weight pillow 10, for example, is 0.1-2 g/cm$^3$. Further, a suitable density for the fiber material for a light-weight pillow 10, for example, can be less than about 0.3 g/cm$^3$. Likewise, a suitable density for the fiber material for a heavy-weight pillow 10, for example, can be greater than about 1.8 g/cm$^3$. Alternatively, the fiber material utilized in combination with the granulated viscoelastic foam as the filler material 46 can have any density in accordance with the desired characteristics of the pillow 10.

In some embodiments, the filler material 46 is comprised of about 50% fiber material, while the remaining composition includes granulated viscoelastic foam. However, a suitable range of fiber material in the filler material 46 for some pillows 10, for example, can be between about 20% and about 80%. Further, a suitable range of fiber material in the filler material 46 for other pillows 10, for example, can be less than about 30% of the filler material 46. Likewise, a suitable range of fiber material in the filler material 46 for still other pillows 10, for example, can be greater than about 70% of the filler material 46.

The filler material 46 of some embodiments of the present invention is a combination of granulated viscoelastic foam and polystyrene balls. The filler material 46 can also or instead include an organic or synthetic fiber material depending on the desired characteristics of the pillow 10. The polystyrene balls may consist of balls of a nominal diameter, or the polystyrene balls may consist of balls of varying diameters. For example, the polystyrene balls may have a nominal diameter of about 5 mm. Also, the polystyrene balls may consist of varying diameters between about 1 mm and about 10 mm. The polystyrene balls can also be as small as 0.5 mm and as large as 20 mm, or the polystyrene balls can have any size in accordance with the desired characteristics of the pillow 10.

The filler material 46 in some embodiments comprises about 50% polystyrene balls, while the remaining composition includes granulated viscoelastic foam. However, a suitable range of polystyrene balls in the filler material 46 for some pillows 10, for example, can be between about 20% and about 80%. Further, a suitable range of polystyrene balls in the filler material 46 for other pillows 10, for example, can be less than about 30% of the filler material 46. Likewise, a suitable range of polystyrene balls in the filler material 46 for still other pillows 10, for example, can be greater than about 70% of the filler material 46.

In some embodiments, the filler material 46 can include granulated highly-elastic ("HE") foam in addition to or instead of granulated viscoelastic foam. Such HE foam can take any of the granulated forms described above with reference to the granulated viscoelastic foam. In some embodiments, the filler material 46 includes HE foam having a density of about 35 kg/m$^3$. However, a suitable density for the HE foam for an average weight pillow 10, for example, can be between about 20 kg/m$^3$ and about 50 kg/m$^3$. Further, a suitable density for the HE foam for a lightweight pillow 10, for example, can be less than about 25 kg/m$^3$. Likewise, a suitable density for the HE foam for a heavyweight pillow 10, for example, can be greater than about 45 kg/m$^3$. Alternatively, the HE foam utilized in the filler material 46 can have any density in accordance with the desired characteristics of the pillow 10.

If used, the granulated HE foam (or other types of granulated non-viscoelastic foam, as described above) may consist of pieces of a nominal length, or the granulated HE foam may consist of pieces of varying lengths. For example, the granulated HE foam may have a nominal length of about 1.3 cm. Also, the granulated HE foam may consist of varying lengths between about 0.6 cm and about 2 cm. The granulated HE foam can be as short as 0.3 cm and as long as 4 cm., or the granulated HE foam can be any length in accordance with the desired characteristics of the pillow 10. In some embodiments, the granulated HE foam is comprised of 16-20% having a length longer than 2 cm, 38-42% having a length between 1 and 2 cm, and 38-42% of the pieces being shorter than 1 cm. Such foam lengths can also be utilized for other granulated non-viscoelastic foams.

In some embodiments, the filler material 46 comprises about 50% granulated HE foam (or other granulated non-viscoelastic foam, as described above), while the remaining composition includes the granulated viscoelastic foam. However, a suitable range of HE foam in the filler material 46 for some pillows 10, for example, is 20%-80%. Further, a suitable range of granulated HE foam in the filler material 46 for other pillows 10, for example, can be less than about 30% of the filler material 46. Likewise, a suitable range of granulated HE foam in the filler material 46 for still other pillows 10, for example, can be greater than about 70% of the filler material 46. Such foam amounts can also be utilized for other granulated non-viscoelastic foams.

The inner sleeve 14 illustrated in FIGS. 1 and 2 comprises cotton or a cotton/polyester blend. However, in other embodiments, the inner sleeve 14 can comprise a number of other suitable materials or combinations of materials for enclosing the filler material 46 of the pillow 10, including without limitation cloth or fabric in woven or non-woven form, webbing, netting, velour, felt, and the like comprised of wool, synthetic materials (e.g., polyester or polyester blends), reticulated and/or non-reticulated viscoelastic and/or non-viscoelastic foam, silk, satin, and the like. Still other sleeve materials 14 capable of retaining the filler material 46 are possible, and fall within the spirit and scope of the present invention.

The inner sleeve 14 can be defined by two separate pieces of material (e.g., layers) connected together along seams, can be a single piece of material folded upon itself, or can be three or more pieces of material connected in any suitable manner (e.g., stitching, gluing, melting, fasteners, and the like, depending at least partially upon the type of material used for the inner sleeve 14).

Also, in those embodiments of the pillow 10 employing reticulated or non-reticulated viscoelastic material for the sleeve 14, such material can have any of the density and ILD characteristics described above in connection with viscoelastic filler material 46. Such material can be about 10 mm thick in some embodiments. A suitable thickness for viscoelastic sleeve material 14 of an average weight pillow 10, for example, can be between about 5 mm and 15 mm. However, a suitable thickness for viscoelastic sleeve material 14 of a heavyweight pillow 10, for example, can be greater than about 13 mm.

The first, second, third, and fourth foam pieces 18, 22, 26, 30 of the pillow illustrated in FIGS. 1 and 2 are each integral and unitary pieces of foam. Each of the first, second, third, and fourth foam pieces 18, 22, 26, 30 is a foam block manufactured in any desired manner, such as by casting, molding, cutting, machining, and the like. As used herein, the term "block" refers to a single integral and unitary piece having any shape desired, and includes foam pieces constructed of multiple elements permanently secured together, such as multiple foam elements melted together to define a single integral and unitary piece.

Each of the first, second, third, and fourth foam pieces 18, 22, 26, 30 illustrated in FIGS. 1 and 2 comprises reticulated or non-reticulated viscoelastic foam. In other embodiments, less than all of the foam pieces 18, 22, 26, 30 comprise reticulated or non-reticulated viscoelastic foam. For example, one or more of the foam pieces 18, 22, 26, 30 can comprise HE foam (described above), which can provide a high degree of resilience for a desired portion of the pillow 10.

The viscoelastic foam pieces 18, 22, 26, 30 illustrated in FIGS. 1 and 2 have a density of about 85 kg/m$^3$. However, a suitable density for the viscoelastic foam pieces 18, 22, 26, 30 for an average weight foam piece for the pillow 10, for example, can be between about 30 and about 140 kg/m$^3$. Further, a suitable density for the viscoelastic foam pieces 18, 22, 26, 30 for a lightweight pillow 10, for example, can be less than about 40 kg/m$^3$. Likewise, a suitable density for the viscoelastic foam pieces 18, 22, 26, 30 for a heavyweight pillow 10, for example, can be greater than about 130 kg/m$^3$. Alternatively, the viscoelastic foam pieces 18, 22, 26, 30 can have any density in accordance with the desired characteristics of the pillow 10. In some embodiments, the viscoelastic foam pieces 18, 22, 26, 30 can have an indentation load deflection, or "ILD," of 65% between 100-500 N loading, and a maximum 10% rebound according to the test procedure governed by the ASTM-D-1564 standard.

The first foam piece 18 illustrated in FIGS. 1 and 2 is an elongated foam piece positioned in the outer sleeve 32 of the pillow 10 and further positioned on a side of the pillow 10. In this regard, the pillow 10 can have a length, width, and a thickness substantially smaller than the length and width. Accordingly, the pillow can have several sides of different dimensions, such as top and bottom sides (defining top and bottom faces of the pillow 10), lateral sides, and front and rear sides. The first foam piece 18 illustrated in FIGS. 1 and 2 extends along a rear side of the pillow 10, and has a cross-sectional shape that is crescent-shaped to receive a portion (e.g., an edge) of the inner sleeve 14 and filler material 46 therein. Accordingly, the inner sleeve 14 with filler material 46 therein can fit inside the recess of the first foam piece 18 to conform to the shape of the first foam piece 18. In other embodiments, the first foam piece 18 can have other cross-sectional shape, including cross-sectional shapes having a concave surface adapted to receive a portion (e.g., an edge) of the inner sleeve 14 and filler material 46 therein. Examples of such cross-sectional shapes include, without limitation, U, V, C, or I-shaped cross sections. Still other cross-sectional shapes having one or more concave surfaces as described above exist, including without limitation dumbbell, hourglass and many irregular cross-sectional shapes.

The concave cross-sectional shape of the first foam piece 18 enables the first foam piece 18 to engage or mate with the inner sleeve 14 and filler material 46 therein. Such engagement can assist in retaining the first foam piece 18 in position at the rear side of the pillow 10 (i.e., running along a rear side of the inner sleeve 14), thereby better enabling the pillow 10 to retain its overall shape. It will be appreciated that such a mating engagement between the first foam piece 18 and the inner sleeve with filler material 46 can be accomplished in a number of other manners. For example, the first foam piece 18 can have a cross-sectional shape with a wedge, lip, or other protrusion adapted to press against and deform the inner sleeve 14 and filler material 46 therein, thereby defining a mating engagement between these pillow components. Still other inter-engaging shapes of the first foam piece 18 and inner sleeve 14 with filler material 46 are possible, and fall within the spirit and scope of the present invention.

The second foam piece 22 is substantially the same as the first foam piece 18 described above, and can have any of the same alternative shapes and features as described above with reference to the first foam piece 18. In other embodiments, the first and second foam pieces 18, 22 have different shapes and/or sizes. The second foam piece 22 illustrated in FIGS. 1 and 2 extends along a front side of the pillow 10, and has a cross-sectional shape that is crescent-shaped to receive a portion (e.g., an edge) of the inner sleeve 14 and filler material 46 therein. Accordingly, the inner sleeve 14 with filler material 46 therein can fit inside the recess of the second foam piece 22 to conform to the shape of the second foam piece 22. Such engagement can help retain the overall shape of the pillow 10 as described above.

The first and second foam pieces 18 illustrated in FIGS. 1 and 2 are positioned to extend the length of the rear and front sides of the pillow 10, respectively, although the first and/or second foam pieces 18 can be longer or shorter as desired. Also, the first and second foam pieces 18 illustrated in FIGS. 1 and 2 each have a substantially constant cross-sectional shape along their respective lengths. In other embodiments, the first and/or second foam pieces 18 can have a changing cross-sectional size and/or shape along their respective lengths.

As best shown in FIG. 1, the inner sleeve 14 with filler material 46 therein is sandwiched between the first and second foam pieces 18, 22. In those embodiments (such as that shown in FIGS. 1 and 2) in which the inner sleeve 14 with filler material 46 is received within either or both of the first and second foam pieces 18, 22, the inner sleeve and filler material can be retained by and between the first and second foam pieces 18, 22. In some embodiments, the first and/or second foam pieces are dimensioned to extend across more or less of the top and bottom surfaces of the inner sleeve 14. For example, the first and second foam pieces 18, 22 can be dimensioned to extend closer to one another on either or both faces of the inner sleeve 14, and in some embodiments to contact one another on either or both faces of the inner sleeve 14. As another example, the first and/or second foam pieces 18, 22 can be dimensioned to receive smaller portions of the inner sleeve 14 than that shown in FIGS. 1 and 2.

The first and second foam pieces 18, 22 illustrated in FIGS. 1 and 2 can provide support and a desired "feel" to a user in the rear and front of the pillow 10, respectively. For example, in the case where the pillow 10 is used as a head pillow, either of the first and second foam pieces 18, 22 can provide support for the neck of a user whose head is lying on the pillow 10. In the case of viscoelastic foam pieces 18, 22, the first and second foam pieces 18, 22 can respond to pressure and/or body heat of the user by better conforming to the user's body (e.g., neck and/or head), thereby distributing the user's weight more evenly across the pillow 10 and reducing high pressure points that could otherwise cause user discomfort. The first and second foam pieces 18, 22 illustrated in FIGS. 1 and 2 are positioned to provide such support while permitting other parts of the user's body (e.g., the back of the head, the face, and the like) to rest upon the inner sleeve 14 with filler material 46 therein. This other type of support can provide support properties desired by the user. For example, in the case of down filler material 46, those portions of the pillow 10 that are away from the first and second foam pieces 18, 22 can have a supporting feeling similar to (or more like) a down pillow. As another example, in the case of a bead or bean filler material 46, those portions of the pillow 10 that are away from the first and second foam pieces 18, 22 can provide a different supporting feeling to the user. Still other examples exist, and can be dependent at least in part upon the type of filler material 46 used and/or the type of material used for the inner sleeve 14.

The locations of the first and second foam pieces 18, 22 are illustrated in FIGS. 1 and 2 by way of example only. In other embodiments, only one of the first and second foam pieces 18, 22 is employed. In still other embodiments, foam pieces similar to the first and second foam pieces 18, 22 can be positioned in any other locations around the pillow 10, such as entirely around the periphery of the pillow 10, on either or both lateral sides of the pillow 10, and the like. Any number of such foam pieces can be larger, smaller, longer, or shorter than that shown in FIGS. 1 and 2 while still falling within the spirit and scope of the present invention.

The third foam piece 26 illustrated in FIGS. 1 and 2 is positioned in the outer sleeve 32 of the pillow 10, and is further positioned on a top face of the pillow 10. The third foam piece 26 can cover any desired portion of the inner sleeve 14, and in the illustrated embodiment covers a portion of the inner sleeve 14 not received within the first and second foam pieces 18, 22. The third foam piece 26 illustrated in FIGS. 1 and 2 extends substantially the entire length of the pillow 10, although the third foam piece 26 can be longer or shorter in other embodiments. In some embodiments, the third foam piece 26 is substantially flat and relatively thin in comparison to its length and width, such as in the form of a pad as shown in FIGS. 1 and 2. In other embodiments, the third foam piece 26 can be thicker or thinner than that shown in FIGS. 1 and 2. Also, the third foam piece 26 can have any flat shape desired, including a rectangular shape extending across any desired portion of the inner sleeve 14 as described above. In other embodiments, the third foam piece 26 can be round, oval, triangular, irregular, or other flat shape, and in many cases is at least partially dependent upon the shape of the pillow 10.

The fourth foam piece 30 is substantially the same as the third foam piece 26 described above, and can have any of the same alternative shapes and features as described above with reference to the third foam piece 26. In other embodiments, the third and fourth foam pieces 26, 30 have different shapes and/or sizes. The fourth foam piece 30 is positioned in the outer sleeve 32 of the pillow 10, and is further positioned on a bottom face of the pillow 10. The fourth foam piece 30 can cover any desired portion of the inner sleeve 14, and in the illustrated embodiment covers a portion of the inner sleeve 14 not received within the first and second foam pieces 18, 22. Like the third foam piece 26, the fourth foam piece 30 extends substantially the entire length of the pillow 10, although the fourth foam piece 30 can be longer or shorter in other embodiments.

The third and fourth foam pieces 26, 30 illustrated in FIGS. 1 and 2 can provide support and a desired "feel" to a user at the top and bottom of the pillow 10, respectively. For example, in the case where the pillow 10 is used as a head pillow, either of the third and fourth foam pieces 26, 30 can provide support for the head of a user on the pillow 10. In the case of viscoelastic foam pieces 18, 22, the third and forth foam pieces 26, 30 can respond to pressure and/or body heat of the user by better conforming to the user's body (e.g., head), thereby distributing the user's weight more evenly across the pillow 10 and reducing high pressure points that could otherwise cause user discomfort. The third and fourth foam pieces 26, 30 illustrated in FIGS. 1 and 2 are positioned to provide such support in conjunction with the type of support provided by the inner sleeve 14 and filler material 46 therein. This combination of support can provide a desirable tactile and cradling feel of the pillow 10 (from the third and fourth foam pieces 26, 30) while still providing the desirable support characteristics of foam, down, beads, beans, or other filler material 46 used.

The locations of the third and fourth foam pieces 26, 30 are illustrated in FIGS. 1 and 2 by way of example only. In other embodiments, only one of the first and second foam pieces 26, 30 is employed. In still other embodiments, foam pieces similar to the first and second foam pieces 26, 30 can be positioned in any other locations around the pillow 10, such as only in a central region on the top and/or bottom sides of the pillow 10, on opposite lateral portions of a side of the pillow 10, across an entire side of the pillow 10 (in which case the third and/or fourth foam pieces 26, 30 can overlap with the first and/or second foam pieces 18, 22, if used), and the like. Any number of such foam pieces can be larger, smaller, longer, or shorter than that shown in FIGS. 1 and 2 while still falling within the spirit and scope of the present invention.

Although the first and second foam pieces 18, 22 are illustrated in FIGS. 1 and 2 as being used in conjunction with the third and fourth foam pieces 26, 30, this need not necessarily be the case. In other embodiments, a pillow 10 can have any one or more and any combination of the first, second, third, and fourth foam pieces 18, 2, 26, 30 in any of the locations described herein.

In some embodiments, one or more of the foam pieces 18, 22, 26, 30 has one or more ventilation holes 50 through which air can pass. Such ventilation holes 50 can facilitate air movement from within or adjacent the inner sleeve 14 to and/or through the outer sleeve 32. Also, such ventilation holes 50 can enable the pillow 10 to be more easily "fluffed" by permitting air movement through the pillow 10. Any number of ventilation holes 50 having any shape, size, combination of shapes and sizes, pattern or patternless arrangement can be employed.

Also, in some embodiments, one or more of the foam pieces 18, 22, 26, 30 can have a sheathing material 54 at least partially surrounding the foam piece(s) 18, 22, 26, 30. The sheathing material 54 in the illustrated embodiment of FIGS. 1 and 2 is a gossamer netting, although any other material in sheet form can instead be utilized, including any of the materials described above in connection with the inner sleeve materials. The sheathing material 54 can help to facilitate assembly and disassembly of the pillow 10, such as by enabling easier movement between adjacent foam components of the pillow 10 during assembly and disassembly of the pillow 10.

In some embodiments, the pillow 10 includes an outer sleeve 32 at least partially surrounding the inner sleeve 14 and filler material 46 therein. The outer sleeve 32 illustrated in FIGS. 1 and 2 is constructed of cotton or a cotton/polyester blend, although any other material or combination of materials in sheet form can be employed, including without limitation any of the materials described above with reference to the materials of the inner sleeve 14. Also, the outer sleeve 32 can be constructed in any of the manners described above with reference to the construction of the inner sleeve 14.

As shown in FIGS. 1 and 2, the outer sleeve 32 can also at least partially enclose some or all of the foam pieces described above. In doing so, the outer sleeve 32 can retain or help retain such pieces 18, 22, 26, 30 in position adjacent the inner sleeve 14 and filler material 46 therein and/or can help to compress such pieces, the inner sleeve 14, and filler material 46 together to any desired extent. The firmness or stiffness of the pillow 10 can be selected by compressing these pillow components 14, 18, 22, 26, 30, 46 within the outer sleeve 32 to any desired extent, such as by selecting an outer sleeve 32 having a particular size. Slightly larger outer sleeves 32 can be used if no compression is desired, although such outer sleeves 32 can still be used to retain the pillow components 14, 18, 22, 26, 30, 46 in desired positions with respect to one another. Gradually smaller outer sleeves 32 can be used for greater compression, which can result in gradually firmer or stiffer pillows 10 as desired. In some embodiments, a user can select from two or more outer sleeve sizes in order to assemble a pillow 10 having a desired firmness or stiffness. Also or alternatively, the size of the outer sleeve 32 can be selected according to the desired appearance of the assembled components 14, 18, 22, 26, 30. For example, if the shape of the assembled components is to be visible through the outer sleeve 32, the outer sleeve 32 can be at least partially taut and/or form fitting, wherein if the desired shape of the pillow is to be more conventional in nature (e.g., resembling a conventional down pillow), the outer sleeve 32 can be loose and generally rectangular.

The outer sleeve 32 can entirely surround the inner sleeve 14, filler material 46 therein, and foam pieces 18, 22, 26, 30 described above. Alternatively, the outer sleeve 32 can surround less than all of these collective pillow components 14 18, 22, 26, 30, 46. For example, the outer sleeve 32 can surround only a central portion of these components 14, 18, 22, 26, 30, 46 (e.g., thereby defining a band about these components 14, 18, 22, 26, 30, 46). As another example, the outer sleeve 32 can surround a collective bottom or top side of these components 14, 18, 22, 26, 30, 46 and corners of these components 14, 18, 22, 26, 30, 46 when assembled, leaving other sides of the assembly uncovered by the outer sleeve 32. As yet another example, the outer sleeve 32 can cover either or both ends of the assembly defined by these components 14, 18, 22, 26, 30, 46 while leaving a central area and/or one or more ends of the assembly uncovered by the outer sleeve 32. In this regard, it should be noted that the outer sleeve 32 can be defined by one or more connected or unconnected portions at least partially surrounding one or more of the pillow components 14, 18, 22, 26, 30, 46 described herein.

Although the outer sleeve 32 illustrated in FIGS. 1 and 2 surrounds the inner sleeve 14, filler material 46 therein, and foam pieces 18, 22, 26, 30, the outer sleeve 32 can at least partially surround less than all of these components 14, 18, 22, 26, 30, 46, such as by surrounding the inner sleeve 14, filler material 46, and only the first and second foam pieces 18, 22, by surrounding the inner sleeve 14, filler material 46, and only the third or fourth foam pieces 26, 30, by surrounding the inner sleeve 14, filler material 46, and only a single foam piece 18, 22, 26, 30, and the like. In such embodiments, the other component(s) can remain outside of the outer sleeve 32, and in some embodiments can be retained in position by a cover 34 (described in greater detail below) or in any of the other manners described above. It should be noted that any number of foam pieces 18, 22, 26, 30 having any shape(s) and position(s) as described above can be received inside and/or outside the outer sleeve 32.

As described above, in some embodiments, the outer sleeve 32 is shaped to extend fully or partially around some or all of the inner sleeve 14, filler material 46 therein, and/or the foam pieces 18, 22, 26, 30. The outer sleeve 32 can be shaped to enable insertion and removal of any number (including none) of these components. For example, the outer sleeve 32 in the illustrated embodiment defines a single internal chamber within which the inner sleeve 14, filler material 46 therein, and foam pieces 18, 22, 26, 30 are removably received.

In other embodiments, the outer sleeve 32 can be shaped to define two or more chambers within which any of these components can be received, such as a first chamber within which the inner sleeve 14, filler material 46, and third and fourth foam pieces 26, 30 are received, and second and third chambers within which the first and second foam pieces 18, 22 are received. As another example, in some embodiments having no third and fourth foam pieces 26, 30, the outer sleeve 32 can be shaped to define a first chamber within which the inner sleeve 14 and filler material 46 are received, and second and third chambers within which the first and second foam pieces 18, 22 are received. In other embodiments having no first and second foam pieces 18, 22, the outer sleeve 32 can be shaped to define a first chamber within which the inner sleeve 14 and filler material 46 are received, and second and third chambers within which the third and fourth foam pieces 26, 30 are received. In still other embodiments, each of the foam pieces 18, 22, 26, 30 in the illustrated embodiment is received within a separate chamber defined at least in part by the outer sleeve 32. The outer sleeve 32 can define any number of chambers within which any number of pillow components 14, 18, 22, 26, 30, 46 can be received.

In those embodiments of the present invention having an outer sleeve 32 defining two or more chambers within which the inner sleeve 14 and filler material 46 and/or any of the foam pieces 18, 22, 26, 30 are received, the outer sleeve 32 can be defined by a single piece of material or by two or more pieces of material connected together in any suitable manner (e.g., by sewing, melting, adhesive or cohesive bonding material, and/or one or more permanent or releasable fasteners, such as snaps, buttons, clasps, pieces of hook and loop fastener material, hook and eyelet sets, overlapping flaps, laces, tied ribbons, strings, cords, and the like). The two or more chambers can enable a user to remove and replace the pillow components received therein, or can be permanently sealed so that one or more pillow components are permanently within or coupled to the outer sleeve 32. For example, in some embodiments it may be desirable to seal some or all of the foam pieces 18, 22, 26, 30 within portions of the outer sleeve 32 while enabling a user to remove the inner sleeve 14 and filler material 46 therein.

As an alternative or in addition to the use of a multi-chamber outer sleeve 32 containing one or more of the pillow components 14, 18, 22, 26, 30, 46 described herein, one or more of the pillow components 14, 18, 22, 26, 30, 46 can be permanently or releasably coupled to the outer sleeve 32 and/or to another of the pillow components 14, 18, 22, 26, 30, 46, such as by any of the connection manners described above with reference to multi-part outer sleeves 32. By way of example only, any or all of the foam pieces 18, 22, 26, 30 in the illustrated embodiment can be sewn, glued, or fastened to the outer sleeve 32, to one another, and/or to the inner sleeve 14.

With continued reference to the embodiment illustrated in FIGS. 1 and 2, a cover 34 can surround and encase the pillow 10, and can conform to the shape of the pillow 10. The cover 34 can be made from a durable and washable fabric material, such as a cotton/polyester blend. Alternatively, the cover 34 can be made from any other type of sheet material desired, including without limitation cloth or fabric in woven or non-woven form, webbing, netting, velour, felt, and the like comprised of cotton, wool, synthetic materials (e.g., polyester or polyester blends), silk, satin, and the like.

As shown in FIGS. 1 and 2, a slot 35 extends across the illustrated cover 34 along the cover's edge. The pillow 10 may be inserted into the cover 34 through the slot 35. The pillow 10 may also be removed from the cover 34 through the slot 35 to facilitate cleaning of the cover 34. The slot 35 can be resealable to close the cover 34 around the pillow 10 and to open the cover 34 for removing the pillow 10. A closure device can be used to open and close the slot 35. In some embodiments, the closure device is a zipper 62, although the closure device could also or instead include snaps, buttons, clasps, pieces of hook and loop fastener material, hook and eyelet sets, overlapping flaps, laces, tied ribbons, strings, cords, and the like. Alternatively, the cover 34 can be a sleeve with at least one end open for insertion of the pillow 10, but having no closure device.

The slot 35 through which the pillow 10 is received in the illustrated embodiment extends across a lateral side of the pillow 10. It will be appreciated, however, that the slot 35 can extend partially or entirely across any side of the pillow 10 (e.g., top, bottom, lateral, front, and/or rear sides), and can extend across two or more sides of the pillow 10 as desired. Also, the cover 34 can have two or more slots in any locations on the pillow 10, any of which can be provided with a closure device as described above.

In some embodiments, and by virtue of the multiple-component construction of the pillows disclosed herein, a user can assemble a pillow 10 to his or her desired specifications. For example, a user may select a single foam piece similar to one of the first and second foam pieces 18, 22 described above for support of the user's neck. As another example, a user can instead select larger or smaller foam pieces similar to the first and second foam pieces 18, 22 described above, and/or can select such pieces having different degrees of firmness, density, porosity, or other foam properties (e.g., reticulated or non-reticulated foam). The resulting components can be positioned in desired locations and orientations with respect to the inner sleeve 14 with filler material 46, and can be received within the outer sleeve 32, if desired.

The pillow 10 can be enclosed in a cover 34. The cover 34 surrounds and encases the pillow 10, and conforms to the shape of the pillow 10. The cover 34 is preferably made from a durable and washable fabric material, such as a cotton/polyester blend. As shown in FIGS. 1 and 2, a slot 58 extends across the cover 34 along the cover's edge. The components of the pillow 10 may be inserted into the cover 34 through the slot 58. The components of the pillow 10 may also be removed from the cover 34 through the slot 58 to facilitate cleaning of the cover 34. The slot 58 is resealable to close the cover 34 around the pillow 10 and to open the cover 34 for removing the pillow 10. A closure device 62 is used to open and close the slot 58. In the preferred embodiment, the closure device 62 is a zipper, although the closure device 62 could also comprise snaps, buttons, hook and loop fasteners, overlapping flaps, laces, or other similar fasteners.

As described in greater detail above, any or all of the first, second, third, and fourth foam pieces 18, 22, 26, 30, inner sleeve 14, filler material 46, and outer sleeve 32 can comprise viscoelastic foam. The viscoelastic foam can possess specific thermally responsive properties which causes the pillow 10 to conform to the shape of the portion of a person's body that contacts the pillow 10. Also, such viscoelastic foam can have a lower stiffness or hardness at an elevated temperature as compared to the stiffness at a cooler temperature. The body heat of the person acts to soften the viscoelastic portion of the pillow 10 in contact with the body, while the portion of the pillow 10 not contacting the body remains more firm. As a result, the pillow 10 utilizing viscoelastic foam can allow for greater comfort over a conventional pillow by accommodating each user's body form. The viscoelastic foam described herein can be made from a polyurethane foam material. However, the viscoelastic foam can be made from any other viscoelastic polymer material preferably (although not necessarily) exhibiting thermally-responsive properties.

The overall stiffness or hardness of the pillow 10 is dependent at least in part upon the stiffness of the individual components of the pillow (e.g., the first, second, third, and fourth foam pieces 18, 22, 26, 30, inner sleeve 14, filler material 46, and outer sleeve 32). As such, the overall stiffness or hardness of the pillow 10 may be affected by varying the stiffness of the material used for these pillow components. For example, in those embodiments in which one or more of these pillow components comprises viscoelastic material, the stiffness of such components can be altered to change the overall stiffness of the pillow 10.

Various features and advantages of the invention are set forth in the following claims.

What is claimed is:

1. A pillow, comprising:

an outer sleeve;

an inner sleeve located within the outer sleeve and defining an internal cavity;

a plurality of loose pieces of filler material contained within the internal cavity of the inner sleeve;

a first unitary piece of foam retained in a first position between the inner and outer sleeves and covering less than all of the inner sleeve, wherein a portion of the inner sleeve of the pillow is exposed to the outer sleeve; and a second unitary piece of foam retained in a second position between the inner and outer sleeves, wherein the first and second pieces of foam are separated by the inner sleeve with the plurality of loose pieces of filler material therein.

2. The pillow claim 1, wherein the first unitary piece of foam has a cross-sectional shape that is crescent-shaped.

3. The pillow of claim 1, wherein the first unitary piece of foam is a substantially planar pad.

4. The pillow of claim 3, wherein a plurality of vent holes extend through the first unitary piece of foam.

5. The pillow of claim 1, wherein the first and second unitary pieces of foam are substantially planar pads between which is received the inner sleeve with the plurality of loose pieces of filler material therein.

6. The pillow of claim 5, wherein the pad comprises viscoelastic foam.

7. The pillow of claim 1, wherein the first and second unitary pieces of foam are substantially elongated and extend along opposite sides of the inner sleeve with the plurality of loose pieces of filler material therein.

8. The pillow of claim 1, wherein the first unitary piece of foam comprises viscoelastic foam.

9. The pillow of claim 1, further comprising a pillow case within which the inner sleeve with the plurality of loose pieces of filler material therein, the outer sleeve, and the first unitary piece of foam are removably received.

10. A pillow, comprising:

a top side;

a bottom side opposite the top side, the top and bottom of the pillow together defining a perimeter of the pillow viewed from above the pillow;

a length;

a width;

a thickness defined between the top side and the bottom side and substantially smaller than the length and width;

a front side extending along the length of the pillow and defining a portion of the perimeter of the pillow;

a sleeve defining an internal cavity;

a plurality of loose pieces of filler material contained within the internal cavity of the sleeve; and an elongated and unitary piece of foam extending along the front side and the sleeve of the pillow, adapted to provide user support at the front side of the pillow, and wherein the elongated and unitary piece of foam covers the sleeve only along the front side of the pillow.

11. The pillow of claim 10, wherein the sleeve is a first sleeve, the pillow further comprising a second sleeve at least partially enclosing the first sleeve and the piece of foam and retaining the piece of foam in position with respect to the first sleeve.

12. The pillow of claim 11, wherein the piece of foam is removable from the first and second sleeves.

13. The pillow of claim 11, further comprising a pillow case within which the first sleeve with the plurality of loose pieces of filler material therein, the second sleeve, and the piece of foam are removably received.

14. The pillow of claim 11, wherein the piece of foam is permanently attached to at least one of the first and second sleeves.

15. The pillow of claim 10, wherein the piece of foam comprises viscoelastic foam.

16. The pillow of claim 10, wherein the piece of foam is a first piece of foam, the pillow further comprising a rear side of the pillow opposite the front side; and a second piece of elongated and unitary piece of foam extending along the rear side and the sleeve of the pillow.

17. The pillow of claim 16, further comprising a pad of material covering a surface of the sleeve and extending between the first and second pieces of foam.

18. The pillow of claim 10, wherein the piece of foam has a crescent-shaped cross-sectional shape.

19. The pillow of claim 18, wherein the piece of foam receives a portion of the sleeve.

20. The pillow of claim 10, wherein the piece of foam is shaped to mate with a portion of the sleeve with the plurality of loose pieces of filler material therein.

21. The pillow of claim 10, further comprising a pad of material covering a surface of the sleeve.

22. A pillow, comprising:

an outer sleeve;

an inner sleeve located within the outer sleeve and defining an internal cavity;

a plurality of loose pieces of filler material contained within the internal cavity of the inner sleeve; and a first unitary piece of foam retained in a first position between the inner and outer sleeves and covering less than all of the inner sleeve, wherein a portion of the inner sleeve of the pillow is exposed to the outer sleeve, and wherein the first unitary piece of foam has a cross-sectional shape that is crescent-shaped.

23. The pillow of claim 22, further comprising a second unitary piece of foam retained in a second position between the inner and outer sleeves, wherein the first and second pieces of foam are separated by the inner sleeve with the plurality of loose pieces of filler material therein.

24. The pillow of claim 23, wherein the first and second unitary pieces of foam are substantially elongated and extend along opposite sides of the inner sleeve with the plurality of loose pieces of filler material therein.

25. The pillow of claim 22, wherein the first unitary piece of foam comprises viscoelastic foam.

26. The pillow of claim 22, further comprising a pillow case within which the inner sleeve with the plurality of loose pieces of filler material therein, the outer sleeve, and the first unitary piece of foam are removably received.

27. A pillow, comprising:

an outer sleeve;

an inner sleeve located within the outer sleeve and defining an internal cavity;

a plurality of loose pieces of filler material contained within the internal cavity of the inner sleeve; and a first unitary piece of foam retained in a first position between the inner and outer sleeves and covering less than all of the inner sleeve, wherein a portion of the inner sleeve of the pillow is exposed to the outer sleeve, wherein the first unitary piece of foam is a substantially planar pad.

28. The pillow of claim 27, further comprising a second unitary piece of foam retained in a second position between the inner and outer sleeves, wherein the first and second pieces of foam are separated by the inner sleeve with the plurality of loose pieces of filler material therein.

29. The pillow of claim 28, wherein the first and second unitary pieces of foam are substantially planar pads between which is received the inner sleeve with the plurality of loose pieces of filler material therein.

30. The pillow of claim 27, wherein the first unitary piece of foam comprises viscoelastic foam.

31. The pillow of claim 27, wherein a plurality of vent holes extend through the first unitary piece of foam.

32. The pillow of claim 27, further comprising a pillow case within which the inner sleeve with the plurality of loose pieces of filler material therein, the outer sleeve, and the first unitary piece of foam are removably received.

33. A pillow, comprising:

an outer sleeve;

an inner sleeve located within the outer sleeve and defining an internal cavity, the inner sleeve having a front side, a rear side, a first lateral side extending between the front and rear sides, and a second lateral side extending between the front and rear sides;

a plurality of loose pieces of filler material contained within the internal cavity of the inner sleeve; and a first unitary piece of foam having a recess in which the front side of the inner sleeve is at least partially received, wherein at least one of the first and second lateral sides of the inner sleeve remain substantially uncovered by the first unitary foam piece.

34. The pillow of claim 33, further comprising a separate, second unitary piece of foam having a recess in which the rear side of the inner sleeve is at least partially received, wherein the first and second lateral sides of the inner sleeve remain substantially uncovered by the first and second unitary foam pieces.

35. The pillow claim 33, wherein the first unitary piece of foam has a cross-sectional shape that is crescent-shaped.

36. The pillow of claim 33, further comprising a substantially planar pad adjacent a top side of the inner sleeve.

37. The pillow of claim 36, further comprising a second planar pad adjacent a bottom side of the inner sleeve, wherein the front side, the top side, and the bottom side of the inner sleeve are substantially surrounded by the first unitary foam piece and the first and second pads.

38. The pillow of claim 36, wherein a plurality of vent holes extend through the pad.

39. The pillow of claim 33, wherein the first and second unitary pieces of foam are substantially elongated.

40. The pillow of claim 33, wherein the first unitary piece of foam comprises viscoelastic foam.

41. The pillow of claim 33, further comprising a pillow case within which the inner sleeve with the plurality of loose pieces of filler material therein, the outer sleeve, and the first unitary piece of foam are removably received.

* * * * *